US010875736B2

(12) United States Patent
Johnson et al.

(10) Patent No.: US 10,875,736 B2
(45) Date of Patent: Dec. 29, 2020

(54) MEDIA TRAY WITH RAMP

(71) Applicant: Hewlett-Packard Development Company, L.P., Houston, TX (US)

(72) Inventors: Bruce G Johnson, LaCenter, WA (US); Elliott Downing, Vancouver, WA (US); Steve O Rasmussen, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/759,342

(22) PCT Filed: Dec. 9, 2015

(86) PCT No.: PCT/US2015/064633
§ 371 (c)(1),
(2) Date: Mar. 12, 2018

(87) PCT Pub. No.: WO2017/099739
PCT Pub. Date: Jun. 15, 2017

(65) Prior Publication Data

US 2018/0250960 A1 Sep. 6, 2018

(51) Int. Cl.
*B65H 31/20* (2006.01)
*B65H 31/30* (2006.01)
(Continued)

(52) U.S. Cl.
CPC ..... *B65H 31/20* (2013.01); *B41J 2/175* (2013.01); *B41J 13/103* (2013.01); *B41J 13/106* (2013.01); *B41J 29/38* (2013.01); *B65H 29/52* (2013.01); *B65H 29/70* (2013.01); *B65H 31/02* (2013.01); *B65H 31/08* (2013.01);
(Continued)

(58) Field of Classification Search
CPC ..... B65H 29/68; B65H 29/70; B65H 31/08; B65H 31/20; B65H 31/24; B65H 31/3018; B65H 2404/61; B65H 2404/63; B65H 2404/65; B65H 2404/655;
(Continued)

(56) References Cited

U.S. PATENT DOCUMENTS 4,844,633 A 7/1989 Greenberg
4,930,765 A * 6/1990 Russel ..... B65H 31/20 271/207
(Continued)

FOREIGN PATENT DOCUMENTS

CN 102198899 9/2011
GB 2324984 11/1998
(Continued)

*Primary Examiner* — Prasad V Gokhale
(74) *Attorney, Agent, or Firm* — Fabian VanCott

(57) ABSTRACT

A media tray may include a number of mezzanines to accumulate media as the media is ejected from a printing device and a number of ramps to selectively engage with a leading edge of the media as the media is accumulated based on a plurality of positions of the number of ramps, the number of ramps positionable based on movement of the number of mezzanines. In one example, movement of the number of mezzanines from a first position to a second position may cause the number of ramps to be in a position to selectively engage and disengage with a leading edge of the media.

20 Claims, 8 Drawing Sheets

(51) Int. Cl.

| | |
|---|---|
| ***G03G 15/00*** | (2006.01) |
| ***B65H 31/02*** | (2006.01) |
| ***B41J 29/38*** | (2006.01) |
| ***B41J 13/10*** | (2006.01) |
| ***B65H 29/52*** | (2006.01) |
| ***B41J 2/175*** | (2006.01) |
| ***B65H 29/70*** | (2006.01) |
| ***B65H 31/08*** | (2006.01) |

(52) U.S. Cl.
CPC ..... *B65H 31/3018* (2013.01); *G03G 15/6538* (2013.01); *B65H 2301/4212* (2013.01); *B65H 2404/61* (2013.01); *B65H 2404/63* (2013.01); *B65H 2404/693* (2013.01); *B65H 2404/7412* (2013.01); *B65H 2404/7414* (2013.01); *B65H 2405/11161* (2013.01); *B65H 2405/11162* (2013.01); *B65H 2511/11* (2013.01); *B65H 2601/2525* (2013.01)

(58) Field of Classification Search
CPC ..... B65H 2405/11161; B65H 2405/11162; B65H 2405/13; B65H 2511/11; B65H 2601/2525
See application file for complete search history.

(56) References Cited

U.S. PATENT DOCUMENTS

| | | | | |
|---|---|---|---|---|
| 5,890,822 | A * | 4/1999 | Saikawa | B41J 13/106 101/419 |
| 5,975,521 | A | 11/1999 | Ono | |
| 6,042,106 | A * | 3/2000 | Kelly | B65H 29/44 271/188 |
| 6,203,006 | B1 | 3/2001 | Semanick et al. | |
| 6,722,650 | B1 | 4/2004 | Abbata et al. | |
| 6,902,162 | B2 | 6/2005 | Otto et al. | |
| 7,458,574 | B2 | 12/2008 | Wilcox et al. | |
| 7,523,931 | B2 | 4/2009 | Chiappetta et al. | |
| 7,810,803 | B2 | 10/2010 | Hoberock et al. | |
| 8,540,227 | B2 | 9/2013 | Buri | |
| 2001/0015144 | A1 * | 8/2001 | Tsurumaki | B65H 29/70 101/232 |
| 2002/0051668 | A1 * | 5/2002 | Kono | B65H 29/70 400/582 |
| 2003/0080503 | A1 * | 5/2003 | Wright | B65H 29/145 271/303 |
| 2003/0206762 | A1 | 11/2003 | Hwang et al. | |
| 2007/0273088 | A1 * | 11/2007 | Ong | B65H 29/26 271/207 |
| 2010/0296853 | A1 | 11/2010 | Valenti et al. | |
| 2014/0321877 | A1 * | 10/2014 | Ono | B65H 31/02 399/92 |
| 2017/0121144 | A1 * | 5/2017 | Otsuka | B65H 31/02 |

FOREIGN PATENT DOCUMENTS

| | | |
|---|---|---|
| JP | H-08309967 A | 11/1996 |
| JP | H-10167551 A | 6/1998 |
| JP | 2014019569 | 2/2014 |

* cited by examiner

MEDIA TRAY WITH RAMP

BACKGROUND

Printing and copying devices may be used to produce physical copies of documents. After being printed, print jobs may be subjected to a number of finishing processes such as stapling and hole punching. These finishing processes may be conducted after the sheets of print media amounting to the entire job has been accumulated and registered such that a stack of print media can be subjected to the finishing processes together.

BRIEF DESCRIPTION OF THE DRAWINGS

The accompanying drawings illustrate various examples of the principles described herein and are a part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
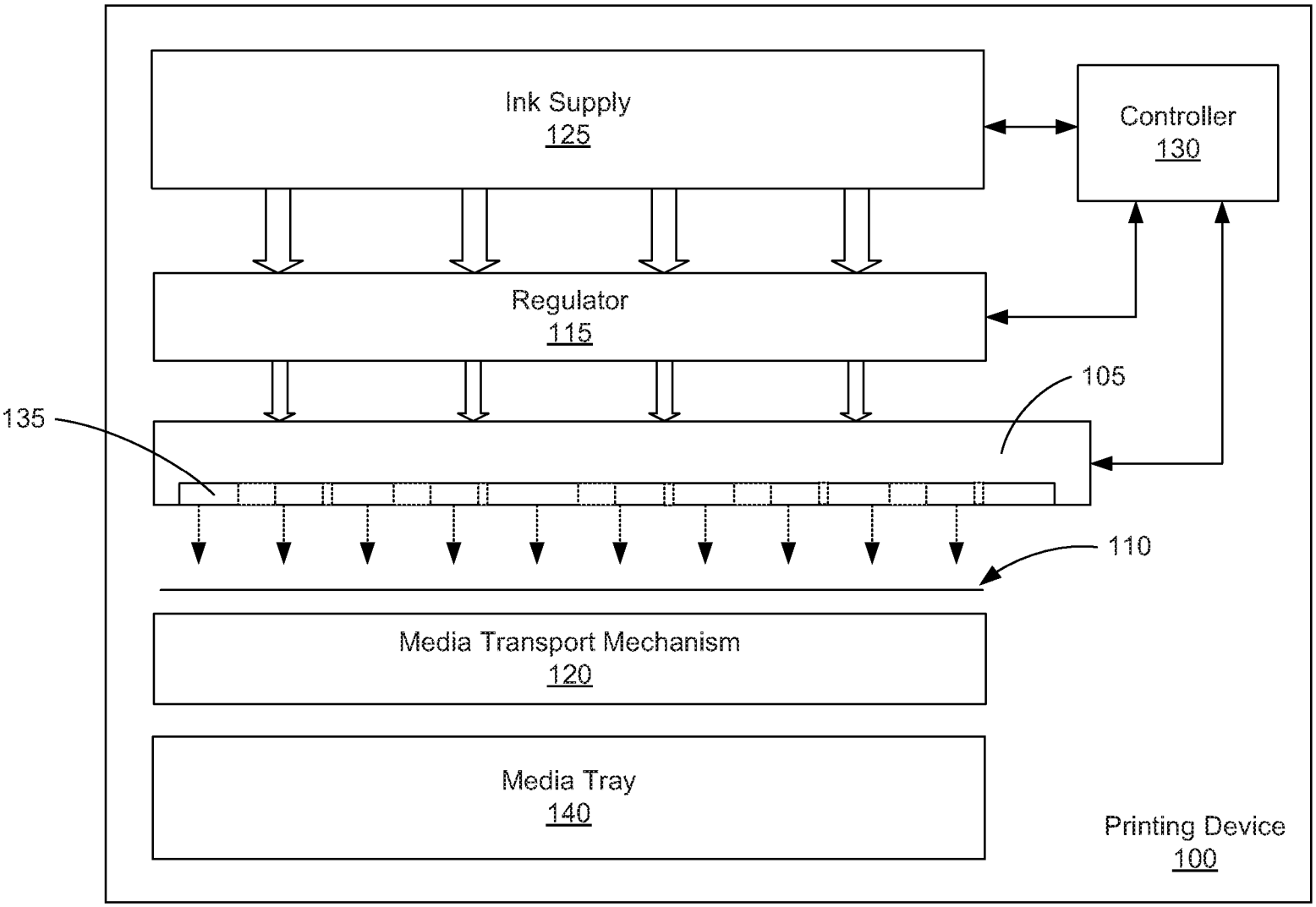
FIG. 1 is a block diagram of a printing device according to one example of the principles described herein.

As mentioned above, printing and copying devices (collectively referred to herein as printing devices) output printed sheets of print media to a common tray or other output area. However, in many instances, the printing device outputs the sheets of print media in a non-registered or non-aligned manner. A user who receives the printed sheets of media from the tray in such a non-registered state is then forced to either register the sheets of print media himself by hand, or present the non-registered sheets of print media as an arguably less professional and unpresentable finished product.

Registration of the sheets of print media before presentation to a user in a tray of the printing device produces a superior, more professional finished product. In order to register the sheets of print media, the sheets of print media are accumulated in an accumulation area. Where the accumulation area is to receive a myriad of types of sheets of print media each with different dimensions, the accumulation area registers the sheets of print media using one of two methods. In one method, the sheets of print media are registered against a wall opposite from where the sheets of print media exit the printing mechanics of the printing device. However, in this example, a curl may have formed on both the trailing edge of a previously ejected sheet of print media and a leading edge of a newly ejected sheet of print media. Curl may result either from heating of the sheets of print media as they progressed through the printing device, from ejecting fluid, or from drying ejection fluid on the surface of the sheets of print media. This curl may result in two sheets of print media colliding together as a subsequent sheet of print media exists the printing mechanics of the printing device. In another method, the collision of any subsequently printed sheet of print media with a previously printed sheet of print media is avoided by registering the sheets of print media against a wall closest to where the sheets of print media exit the printing mechanics. In this example, the object is to place the trailing edge of a previously printed sheet under the exiting rollers with enough clearance such that the trailing edge cannot collide with a leading edge of a subsequently printed sheet of print media. In this method, however, additional registering mechanics are used to reverse the direction of each sheet of print media in order to register the sheets of print media against that wall of the accumulation area.

The present specification, therefore, describes a media tray in a printing device that receives any size of print media and registers the sheets of print media at a wall away from the location where the print media exit the printing mechanics of the printing device. The media tray may include a mezzanine level intermediate to the exit and a floor of the tray. The mezzanine level may include a number of media support members herein referred to as mezzanines. The mezzanines may include a number of articulating extension bars that extend away from the mezzanines via extension arms when the sheets of print media are accumulated on the mezzanines. The mezzanines may further include a number of ramps that, as the sheets of print media are transported away from the exit of the printing mechanics, prevent a leading edge of the exiting sheet of print media from colliding with a trailing edge of a previously accumulated sheet of print media on the mezzanines. The ramp may be selectively erected or laid flat with the mezzanines based on the size and/or type of media exiting the printing mechanics.

The present specification also describes a media tray that may include a number of mezzanines to accumulate media as the media is ejected from a printing device and a number of ramps to selectively engage with a leading edge of the media as the media is accumulated based on a plurality of positions of the number of ramps, the number of ramps positionable based on movement of the number of mezzanines. In one example, movement of the number of mezzanines from a first position to a second position causes the number of ramps to be in a position to selectively engage and disengage with a leading edge of the media.

The present specification further describes a printing device including a media tray comprising a mezzanine level comprising a number of media support members, the mezzanine level being intermediate to a floor level and a media output level wherein the media support members include a number of ramps to selectively prevent a leading edge of a first print media from colliding with a trailing edge of a second print media accumulated on the support members.

The present specification also describes a method of preventing collision of media in a media tray including moving a support structure from a first position to a second position to receive a number of sheets of media on a mezzanine level within the media tray, erecting a ramp on the support structure, and accumulating the number of sheets of media on the support structure by translating each sheet over the ramp preventing a leading edge of each sheet from colliding with a trailing edge of a previously accumulated sheet in the tray.

As used in the present specification and in the appended claims, the term "a number of" or similar language is meant to be understood broadly as any positive number comprising 1 to infinity.

In the following description, for purposes of explanation, numerous specific details are set forth in order to provide a thorough understanding of the present systems and methods. The present apparatus, systems and methods may be practiced without these specific details. Reference in the specification to "an example" or similar language means that a particular feature, structure, or characteristic described in connection with that example is included as described, but may not be included in other examples.

Turning now to the figures, FIG. 1 is a block diagram of a printing device (100) according to one example of the principles described herein. The printing device (100) may include, in one example, a print bar (105) including a number of printheads (135), flow regulators (115) associated with the print bar (105), a media transport mechanism (120), ink or other ejection fluid supplies (125), a media tray (140), and a controller (130). Although FIG. 1 shows a print bar (105) including a number of printheads (135)

The controller (130) may represent the programming, processor(s), associated data storage device(s), and the electronic circuitry and components used to control the operative elements of a printing device (100). As will be discussed in more detail below, the controller may provide instructions regarding what type of media is being used in the printing device and cause, via a number of signals, the media tray (140) to either erect or lay flat a number of ramps associated with the media tray (140).

The print bar (105) may include an arrangement of printheads (135) for dispensing printing fluid onto a continuous web of paper or other print media (110). The ejection fluid supply (125) and regulators (115) may provide and regulate the amount of ejection fluid provided to the print bar (105) and printheads (135). The media transport (120) may include any number of rollers or other transport mechanisms used to bring a sheet of print media into the printing mechanics of the printing device (100), pass the sheet of print media under the print bar (105), and eject the sheet of print media out of the printing mechanics and into the media tray (140). All of these processes may be controlled by the controller (130).

The media tray (140) may be a media receiving tray or media accumulation tray to receive and accumulate, respectively, a number of sheets of print media. As mentioned above, may include a number of mezzanine support structures on a mezzanine level intermediate to the media transport (120) mechanisms and a floor of the media tray (140). The mezzanine support structures may include a number of ramps that prevent a leading edge of any sheet of print media exiting the printing device (100) via that media transport (120) to be lifted up and over a trailing edge of a previously ejected sheet of print media.

Figure 2:
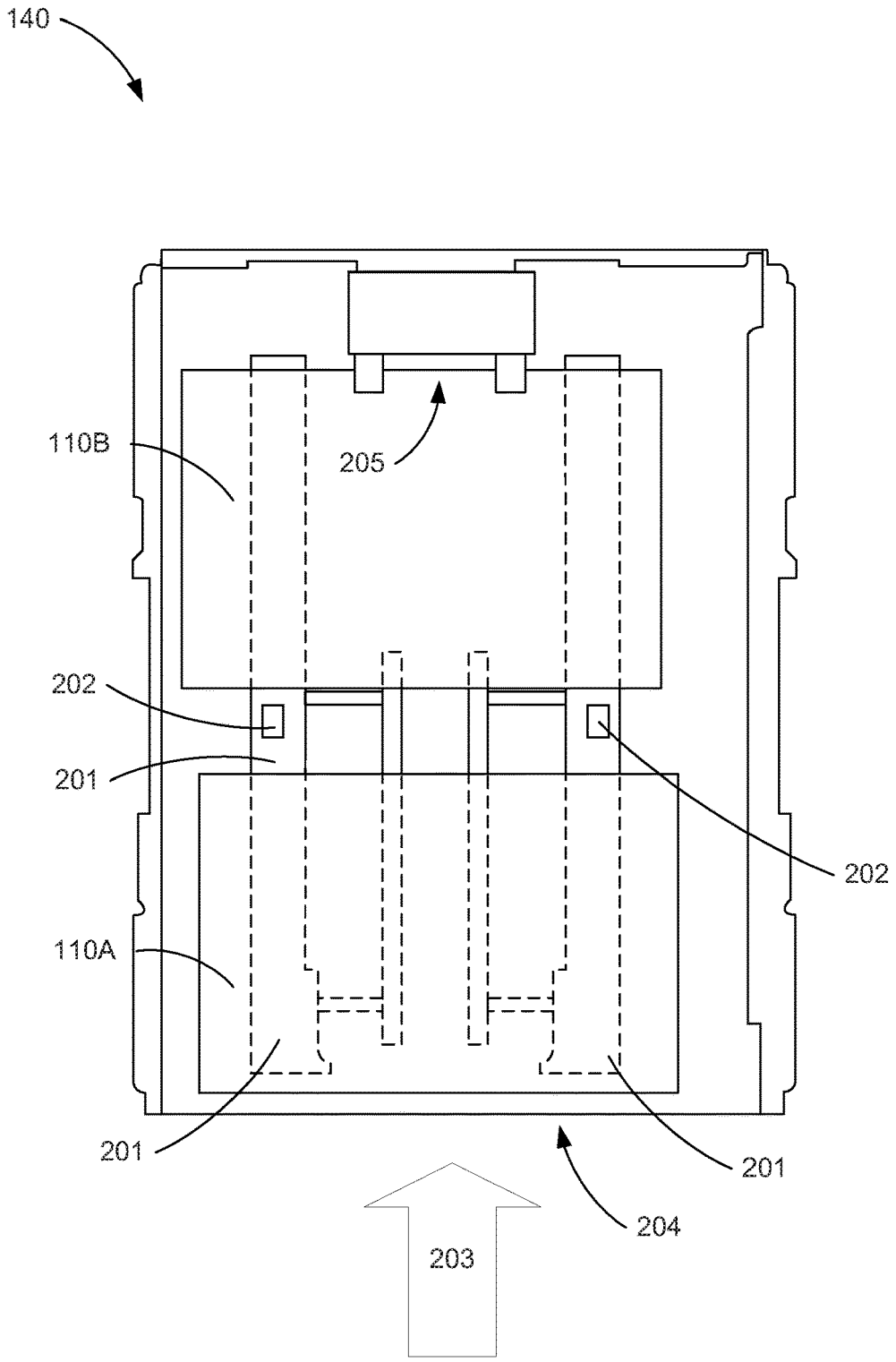
FIG. 2 is a top view diagram of a media tray including a number of ramps according to one example of the principles described herein.

Turning now to FIG. 2, a top view diagram of a media tray (140) including a number of ramps (202) according to one example of the principles described herein is shown. The media tray (140) includes, at a mezzanine level, a number of mezzanine support members (201). In one example, each of the mezzanine support members (201) may include at least one of the number of ramps (202) that may be selectively erected and laid flat as described below. In FIG. 2, the media feed path of the print media (110) is from bottom to top of the figure as indicated by a media feed path arrow (203). The length of the ramp (202) may be short or long based on an expected height of the accumulated print media. A relatively longer ramp (202) may be used where the stack of the accumulated print media is relatively thick.

During operation, the media tray (140) receives print media (110) and, via a transport system in the media tray (140) and the media transport mechanism (120), advances the media from a first wall (204) of the media tray (140) to a second wall (205) of the media tray (140). During this operation, a sheet of the print media (110) entering the media tray (140) from the first wall (204) passes over the ramps (202) with the leading edge of the ejected print media (110) abutting the ramps (202). This prevents a curled leading edge of the incoming print media (110A) from colliding with any accumulated print media (110B) accumulated along the second wall (205) of the media tray (140).

As will be discussed below, in one example, the ramps (202) may be selectively erected or laid flat based on the dimensions of the print media (110). The ramps (202) may be positioned at an intermediate location between the first (204) and second wall (205) on the mezzanine support members (201). The dimensions of some print media (110) may be such that the accumulated print media (110) will not overlap onto the ramps (202). In this case, the ramps (202) may be caused to be erected as describe below. The dimensions of other print media (110) may be such that the accumulated print media (110) will overlap onto the ramps (202). In this case, the ramps (202) may be laid flat such that the print media (110) may rest flat against the mezzanine support members (201).

Figure 3:
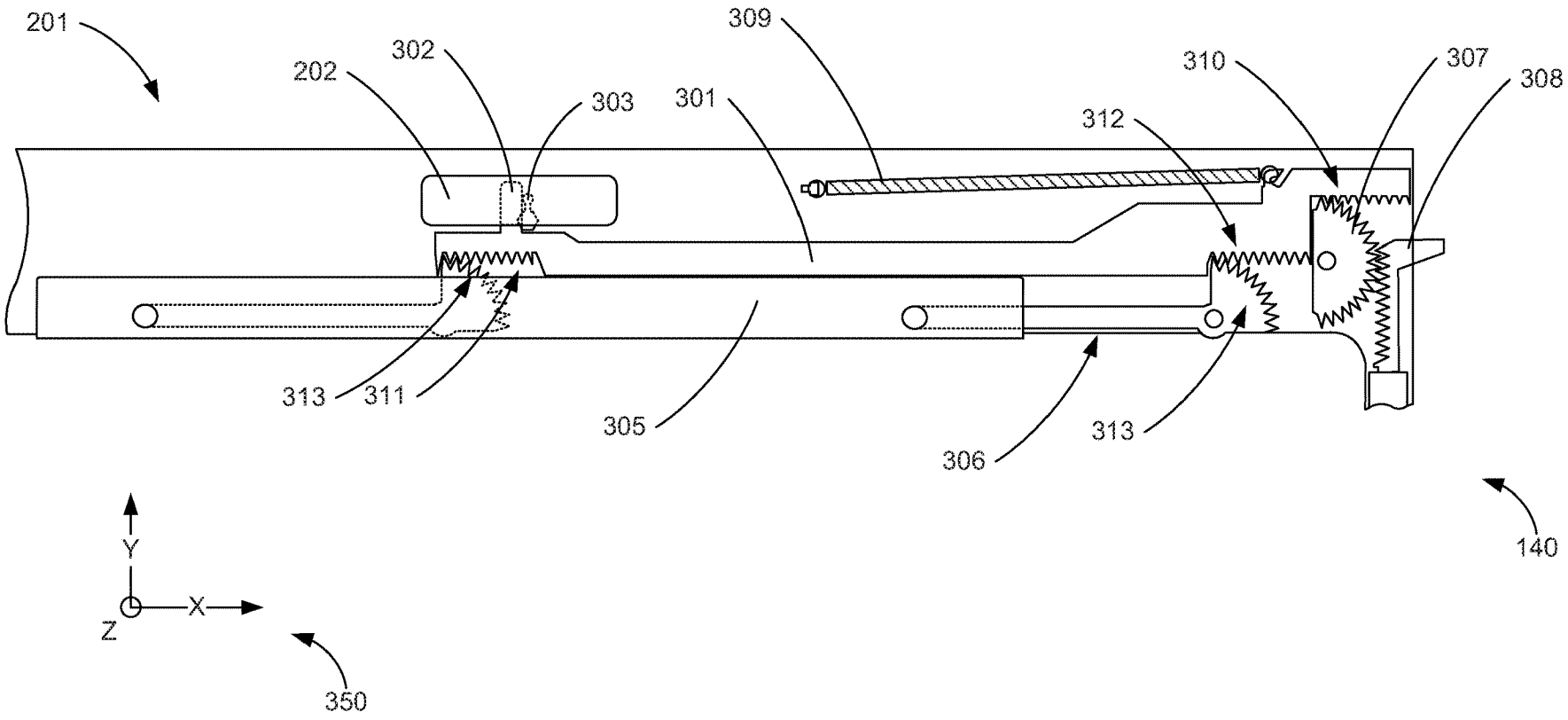
FIG. 3 is a top view of a mezzanine support member including a ramp according to one example of the principles described herein.

FIG. 3 is a top view of a mezzanine support member (201) including a ramp (202) according to one example of the principles described herein. Although FIG. 3 shows a single mezzanine support member (201), the media tray (140) may comprise any number of mezzanine support members (201). In one example, the number of mezzanine support members (201) is two with a second mezzanine support member (201) being mirrored to the mezzanine support member (201) shown in FIG. 3.

The mezzanine support member (201) may include a rack arm (301), a rack arm finger (302), a kickstand (303), a ramp (202), articulating extension bars (305), extension arms (306), a half gear (307), and a linking gear (308). Each of these will now be described in more detail.

The mezzanine support member (201) includes a rack arm (301) that includes a rack arm finger (302) (in ghost). The rack arm (301) moves in an x-direction parallel to the mezzanine support member (201) and in FIG. 3, in a x-direction according to a three-dimensional Cartesian coordinate indicator (350) shown in FIG. 3. Throughout the drawings, the three-dimensional Cartesian coordinate indicator is provided to orient the reader as to directions of movement and forces placed on the elements of the mezzanine support member (201). Throughout the figures, a circle located at the origin of the coordinate indicator indicates that the positive direction is moving or coming out of the page toward the reader. Conversely, a square indicates that the negative direction is moving or coming out of the page toward the reader.

In FIG. 3, the mezzanine support member (201) and its associated elements may move along a Y-direction. FIG. 3 shows the mezzanine support member (201) in a first position within the media tray (140). Here, the mezzanine support member (201) is furthest out from the center of the media tray (140) in the Y-direction. In this position, the mezzanine support member (201) allows, if present, any accumulated print media (110, 110A, 110B) to fall onto a floor of the media tray (140) positioned below the mezzanine support members (201). As will be described in more detail below, in one example, the movement of the mezzanine support members (201) to this first position causes the ramps (202) to deploy and become erect. Further, the movement of the mezzanine support members (201) to a second position places the mezzanine support members (201) in a position to begin accumulating print media (110) thereon. Still further, the movement of the mezzanine support members (201) to a third position may disengage the ramp (202) so that certain sizes of print media (110) may be accumulated onto the mezzanine support members (201). The movement of the mezzanine support members (201) to the third position may be dependent on the size of the print media (110) used.

With the mezzanine support member (201) being in this position, the rack arm (301) is the furthest in the x-direction it can travel towards the first wall (204) of the media tray (140). The movement of the mezzanine support member (201) into the first position causes the rack arm (301) to move to the position shown in FIG. 3 through the use of a linking gear (308) and a half gear (307). As the mezzanine support member (201) moves out from the center of the media tray (140) in the Y-direction, the half gear (307) rotates about a pivot due to the gear teeth interfacing between the linking gear (308) and the half gear (307). Similarly, the rack arm (301) moves towards the first wall (204) of the media tray (140) due to the gear teeth interfacing between the half gear (307) and a first set of teeth (310) defined on the rack arm (301).

As the rack arm (301) moves towards the first wall (204) of the media tray (140), the rack arm finger (302) engages with the ramp (202) and kickstand (303) positioned under the ramp (202). As the rack arm finger (302) engages the ramp (202), it erects the ramp (202) and rotates the kickstand (303) about a kickstand pivot under the ramp (202) in preparation to receive a number of sheets of print media (110) on the mezzanine support members (201).

In one example, a spring (309) may be resistive coupled to a portion of the mezzanine support member (201) at one end and the rack arm (301) at another. The spring (309) may provide a resistive force against the rack arm (301) such that the rack arm (301) may return to a position closer to the second wall (205) of the media tray (140) during other operations of the mezzanine support member (201). In FIG. 3, the spring (309) is in an extended state and applies a force to the rack arm (301).

Figure 4:
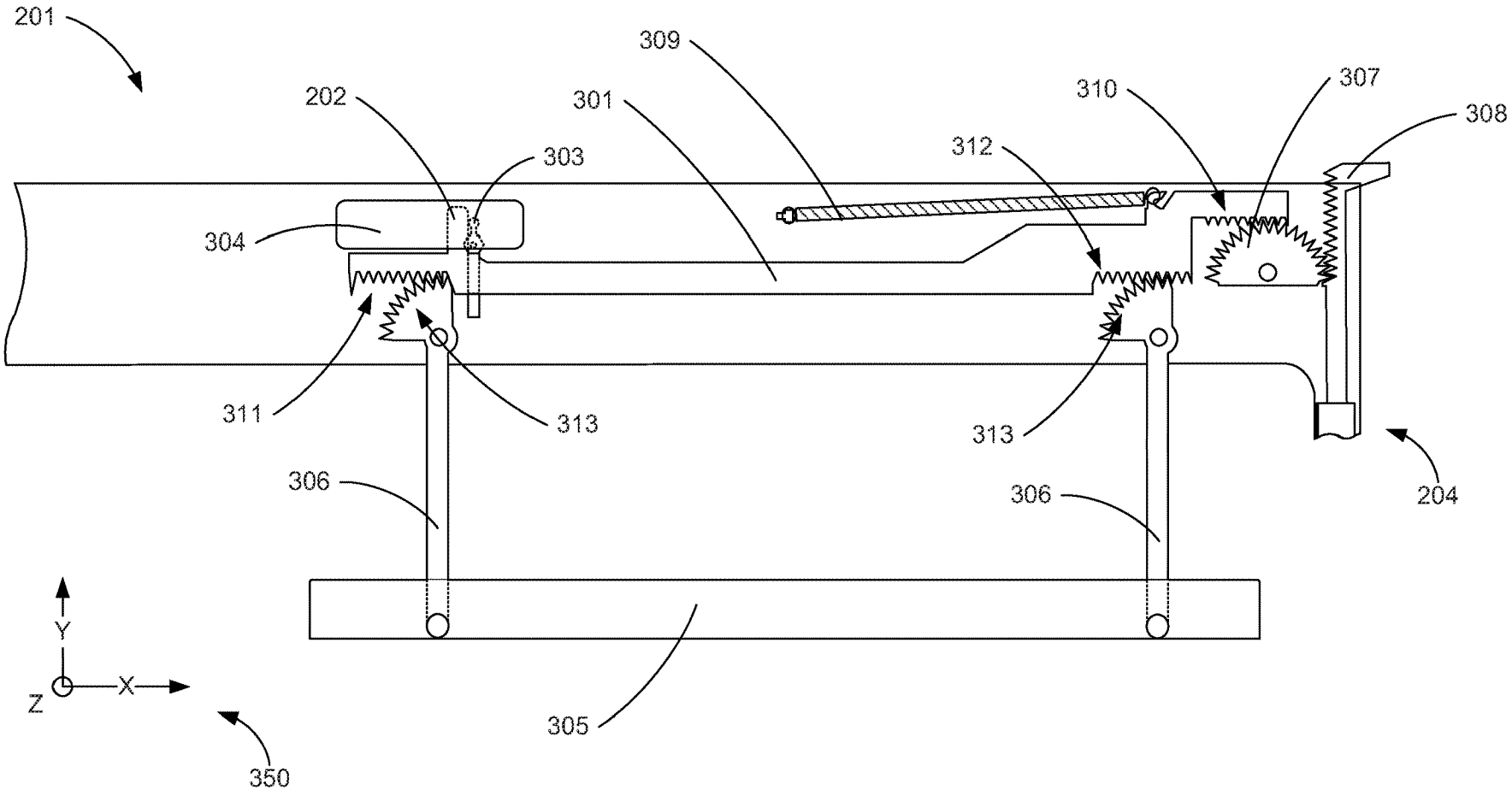
FIG. 4 is a top view of the mezzanine support member of FIG. 3 including a ramp according to one example of the principles described herein.

The rack arm (301) may further include a second (311) and third (312) set of teeth defined therein to interface with a number of teeth (313) defined in the extension arms (306) associated with the mezzanine support member (201) and which can be viewed better in FIG. 4. FIG. 4 is a top view of the mezzanine support member (201) of FIG. 3 including a ramp (202) according to one example of the principles described herein. In FIG. 4, the mezzanine support member (201) has moved to a second position closer to the center of the media tray (140). The movement of the mezzanine support member (201) may be accomplished via activation of a number of servomechanisms activated by the controller (FIG. 1, 130). When the mezzanine support member (201) moves to this second position, the rack arm (301) moves in the X-direction towards the second wall (205) of the media tray (140) by the force of spring (309). This movement of the rack arm (301) causes the extension arms (306) to push the articulating extension bar (305) away from the rack arm (301) using the interface between the second (311) and third (312) set of teeth defined in the rack arm (301) and the teeth (313) defined in the extension arms (306). Because each extension arm (306) comprises a pivot point, the interface between these sets of teeth cause the extension arms (306) coupled to the articulating extension bar (305) to move out from the rack arm (301) and mezzanine support member (201) and towards the center of the media tray (140). The extension arms (306) and articulating extension bars (305) may provide additional support to print media (110) as it accumulates on the mezzanine support members (201).

In addition, when the rack arm (301) moves in the X-direction towards the second wall (205) of the media tray (140), the rack arm finger (302) moves away from the ramp (202) and kickstand (303) and the kickstand (303) is left to prop up the ramp (202). This may be done in preparation to divert a leading edge of print media (110) away from a trailing edge of print media (110) accumulated on the mezzanine support member (201).

As described above, the mezzanine support members (201) may be moved into a third position. As will be described below, movement of the mezzanine support member (201) into the third position causes the kickstand (303) to be removed from underneath the ramp (202) in turn causing the ramp (202) to fall flat against the mezzanine support member (201). This movement from the second to the third position may be caused the by the activation of the servomechanism by the controller (FIG. 1, 130). The controller (FIG. 1, 130) may cause the mezzanine support member (201) to move to the third position when it is determined that the dimensions of the print media (110) are large enough to cover the ramp (202) when the print media (110) is accumulated on the mezzanine support member (201).

Figure 5:
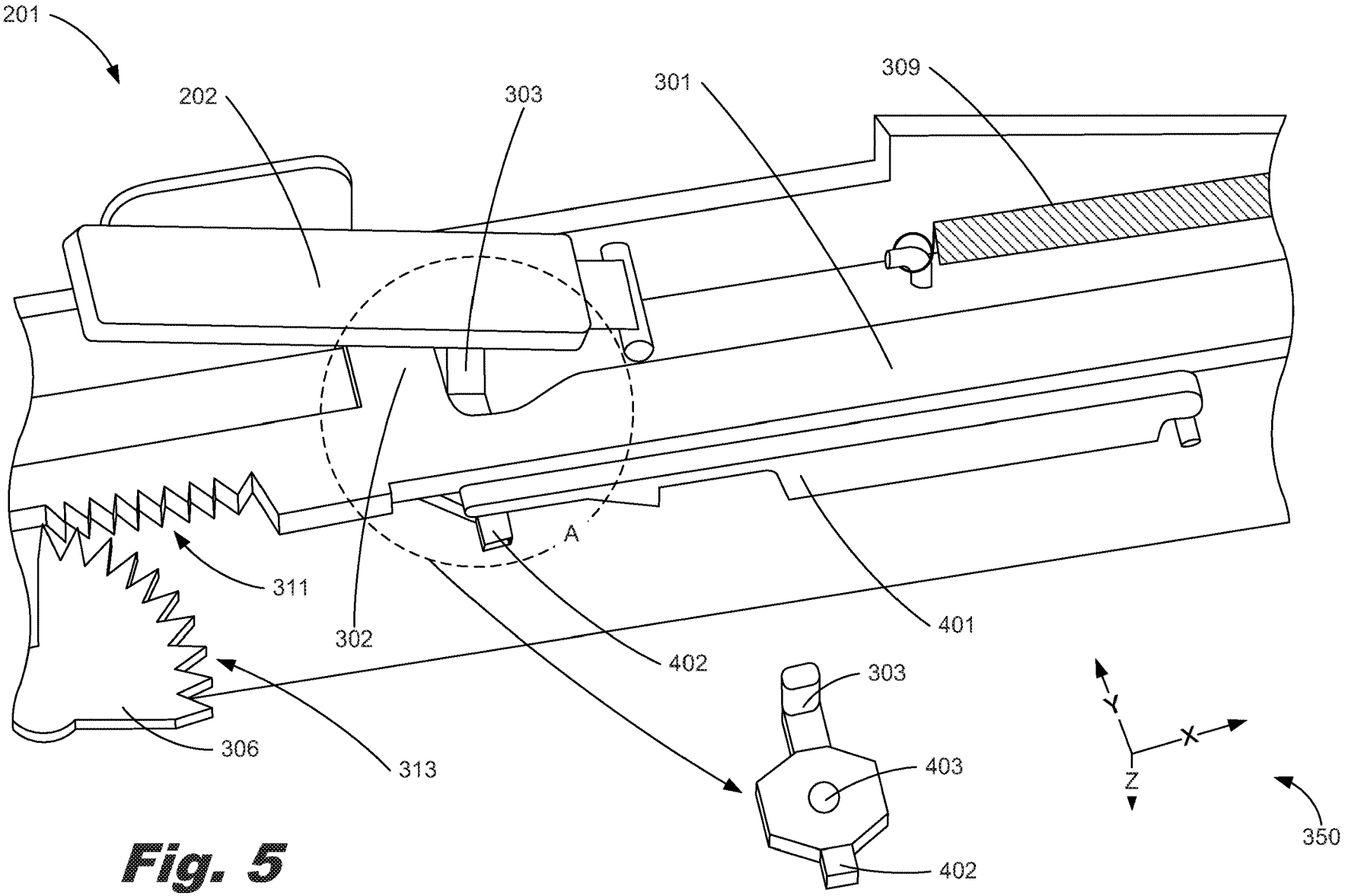
FIG. 5 is a perspective view of the ramp of FIGS. 3 and 4 according to one example of the principles described herein.

FIG. 5 is a perspective view of the ramp (202) of FIGS. 3 and 4 according to one example of the principles described herein. This figure shows in more detail the spring (309), kickstand (303), rack arm (301), rack arm finger (302), and a rack arm trigger (401) used to remove the kickstand (303) from under the ramp (202). Additionally, this figure shows the mezzanine support member (201) in the second position before the mezzanine support member (201), when directed, moves to the third position described above.

As can be seen in FIG. 5, the rack arm (301) further includes a rack arm trigger (401) that may engage with a kickstand finger (402) coupled to the kickstand (303). FIG. 5 further shows a circle (A) encompassing the kickstand (303) and kickstand finger (402). This circle (A) provides a callout directed towards a kickstand (303) and kickstand finger (402) as it would appear without the rack arm (301) and rack arm trigger (401) obstructing the view of the kickstand (303) and kickstand finger (402). As can be seen in the callout figure, the kickstand (303) and kickstand finger (402) may revolve among a common kickstand pivot (403). In one example, as a consequence of revolving the kickstand finger (402) about the kickstand pivot (403) in a counterclockwise manner, the kickstand (303) will also revolve about the kickstand pivot (403) in a counterclockwise manner.

When the rack arm trigger (401) engages with the kickstand finger (402), the rack arm trigger (401) is in position to pull the kickstand finger (402) causing the kickstand (303) to be removed from underneath the ramp (202). Again, this causes the ramp (202) to fall down flush with the mezzanine support member (201) thereby accommodating for relatively larger dimensioned print media (110) to accumulate on the mezzanine support member (201).

Figure 6:
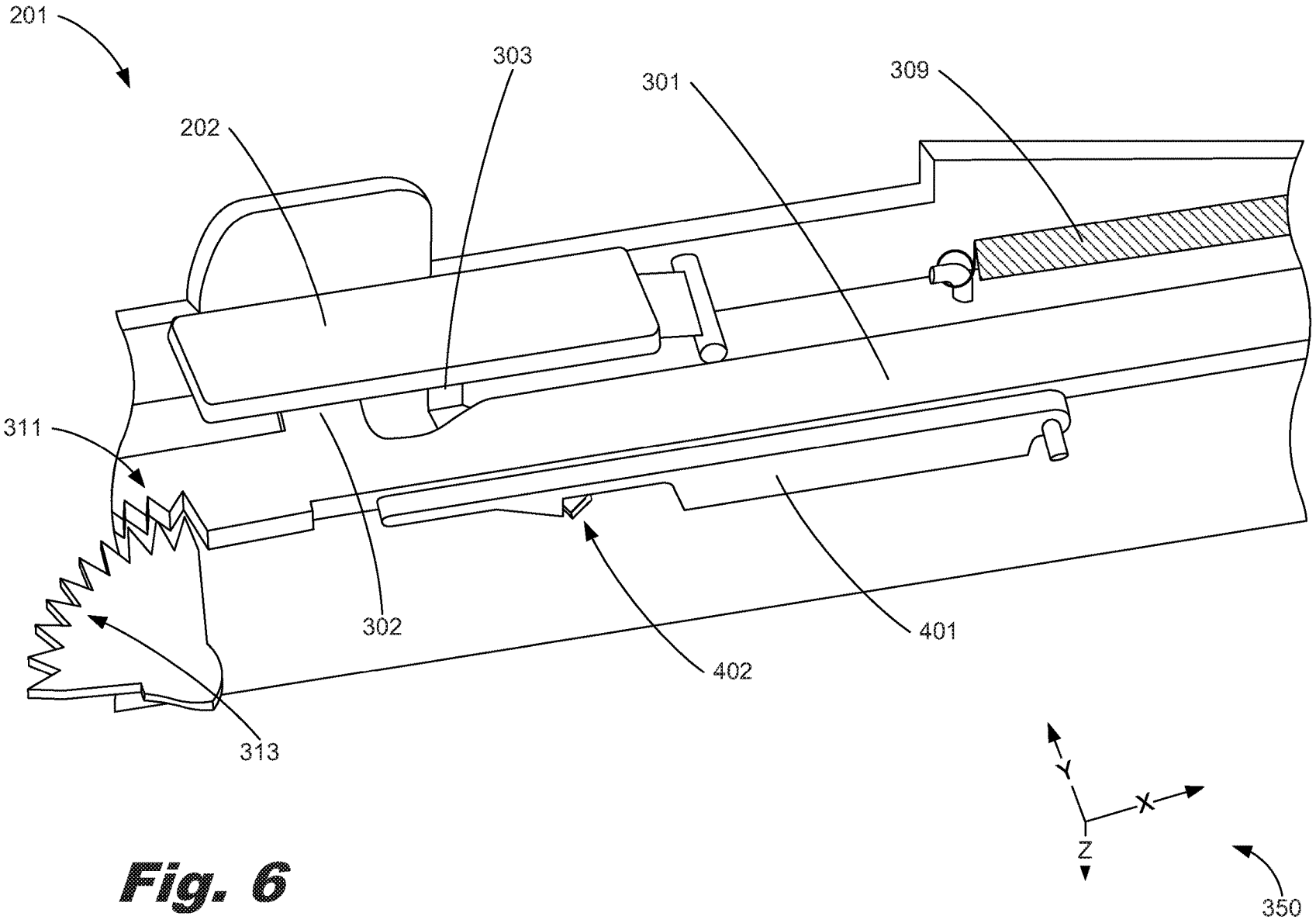
FIG. 6 is a perspective view of the ramp of FIGS. 3, 4, and 5 according to one example of the principles described herein.

FIG. 6 is a perspective view of the ramp (202) of FIGS. 3, 4, and 5 according to one example of the principles described herein. In this figure, the mezzanine support member (201) has been moved to a third position in the Y-direction. This causes the rack arm trigger (401) coupled to the rack arm (301) to disengage the kickstand (303) from under the ramp (202) by pulling on the kickstand finger (402). As described above, movement of the mezzanine support member (201) to this third position causes the ramp (202) to fold down flush with the mezzanine support member (201). In one example, this may be done based on whether the dimensions of the print media (110) would cover the ramp (202).

In one example, the mezzanine support member (201) may return to the second position described above without the kickstand (303) re-engaging the ramp (202) and causing the ramp to become erect again. Instead, the mezzanine support member (201) may move from the third position to the second position to better support the print media (110) as the print media (110) accumulates on the mezzanine support member (201).

In one example, the distance between the mezzanine support members (201) and their associated articulating extension bars (305) could be short enough to support the print media (110) as it accumulates on the media transport mechanism (120). In this example, the mezzanine support member (201) may remain in the third position until the accumulation of print media (110) ends and the print job is over. Certain finishing processes such as, but not limited to, stapling and hole punching may then be conducted and the mezzanine support members (201) may return to their first position.

In either of these examples, returning the mezzanine support members (201) to their first position causes the finished print job to fall down to a floor level of the media tray (140). Additionally, returning the mezzanine support members (201) to their first position causes the rack arm (301) to, via the rack arm finger (302), engage the kickstand (303) and the ramp (202) thereby erecting the ramp (202) again in preparation for another print job. The process may be repeated as described above for any number of print jobs handled by the printing device (FIG. 1, 100).

Figure 7:
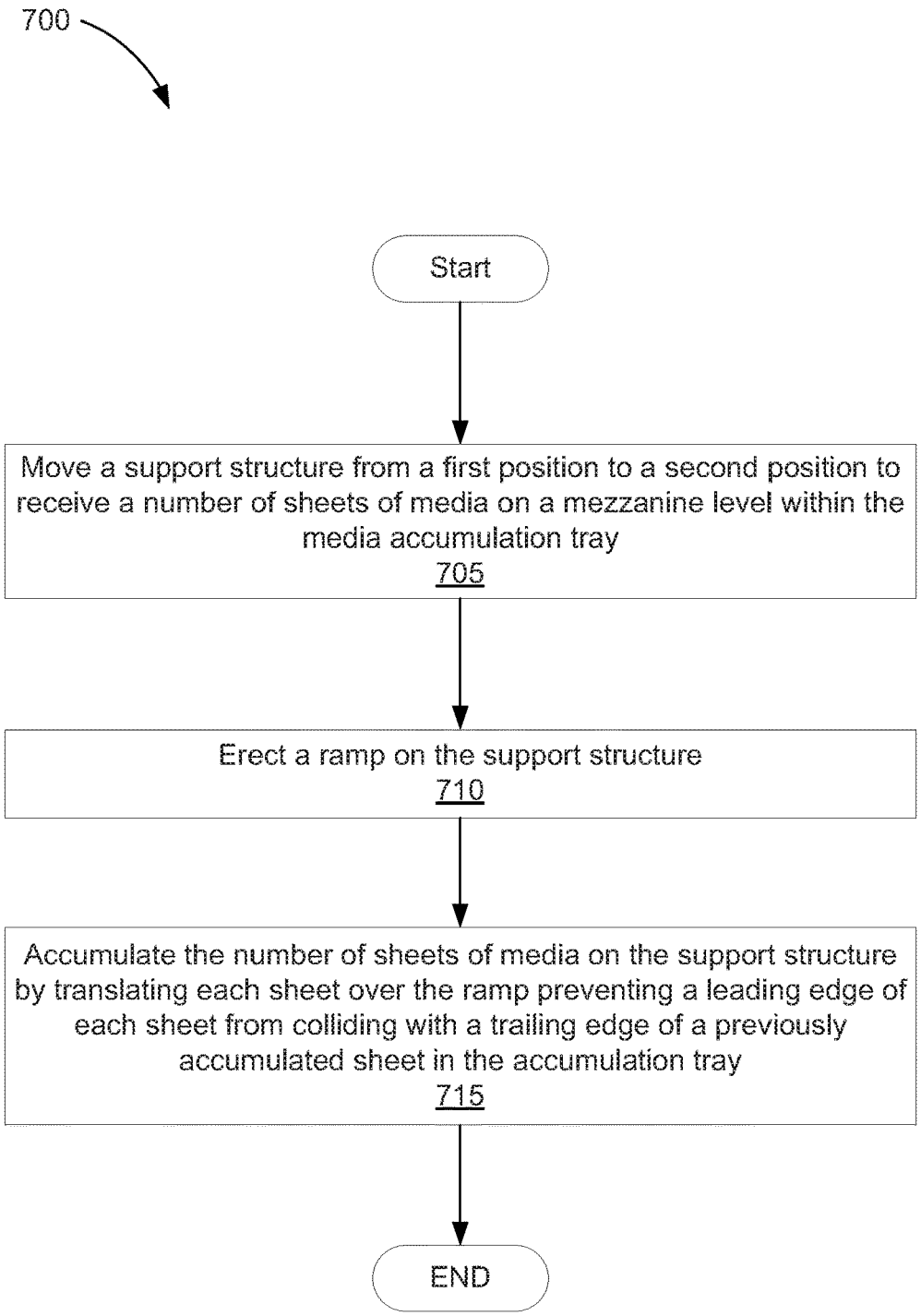
FIG. 7 is a flowchart showing a method of preventing collision of media in a media tray according to one example of the principles described herein.

FIG. 7 is a flowchart showing a method (700) of preventing collision of media in a media tray according to one example of the principles described herein. The method (700) may begin by moving (705) a support structure from a first position to a second position to receive a number of sheets of print media (110) on a mezzanine level within the media tray (140). As described above, the support may include the mezzanine support member (201) as well as the articulating extension bars (305), the extension arms (306) and other portions of the mezzanine support member (201). As also describe above, movement of the mezzanine support member (201) causes movement of the rack arm (301) causing, at least, the articulating extension bars (305) to be extended.

The method (700) may continue with erecting (710) the ramp (202) on the support structure. This process may be accomplished before, during, or after moving (705) a support structure from a first position to a second position.

The method (700) may continue by accumulating (715) the number of sheets of print media (110) on the support structure by translating each sheet over the ramp preventing a leading edge of each sheet from colliding with a trailing edge of a previously accumulated sheet in the media tray.

Figure 8:
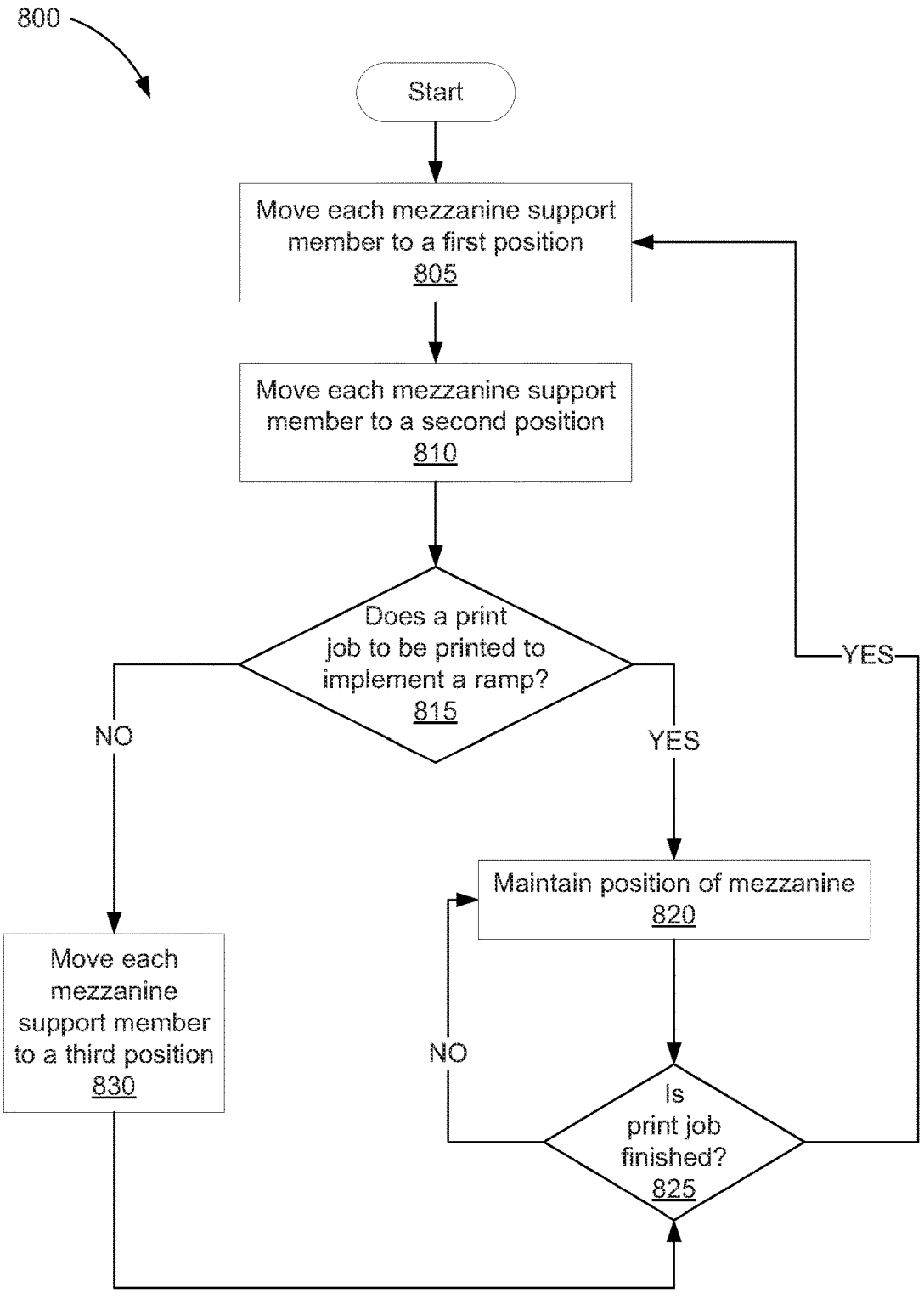
FIG. 8 is a flowchart showing a method of preventing collision of media in a media tray according to one example of the principles described herein.

FIG. 8 is a flowchart showing a method (800) of preventing collision of media in a media tray according to one example of the principles described herein. The method (800) may begin with moving (805) each mezzanine support member (201) to a first position. The first position as described above is a position the mezzanine support members (201) are in such that the mezzanine support members (201) are furthest out from the center of the media tray (140) in the Y-direction. As a result of moving (805) the mezzanine support members (201), the extension arms (306) may move the articulating extension bars (305) towards the mezzanine support member (201) in a contracted position as shown in FIG. 3. Additionally, as a result of moving (805) the mezzanine support members (201), the ramp (202) is erected by the rack arm finger (302) pushing the ramp (202) and kickstand (303) under the ramp (202). The ramp (202) is maintained in an erect position by the kickstand (303).

The method (800) may continue with moving (810) each mezzanine support members (201) to a second position. As a result of moving each of the mezzanine support members (201) to a second position, the extension arms (306) begin to and fully extend the articulating extension bars (305). Additionally, the rack arm finger (302) moves out from under the ramps (202) as describe above. Further, the rack arm trigger (401) engages with the kickstand finger (402) in preparation, when appropriate, to move the kickstands (303) from underneath the ramps (202).

The method (800) may continue by determining (815) whether a print job to be printed is to implement the ramp (202) during accumulation of the print media (110). The decision may, in one example, be made by the controller (FIG. 1, 130). As described above, the decision as to whether the ramp (202) is to be used during the accumulation process may depend on the dimensions of the print media (110). In this example, if the size of the print media is large enough to, when accumulated in the media tray (140), cover the ramp (202), the ramp (202) is determined not to be implemented. Otherwise, the use of the ramp (202) is continued.

Where the use of the ramp (202) is to be continued (YES Decision, 815), the mezzanine support members (201) are maintained (820) in the second position until it is determined (825) whether the print job is finished and the accumulation of the print media (110) on the mezzanine support members (201) has ended. In one example, the determination (815) as to whether a print job to be printed is to implement the ramp (202) during accumulation of the print media (110) may be made before moving (810) each mezzanine support members (201) to the second position. In this example, where the decision is to not implement the ramp (202), movement of the mezzanine support members (201) may be coordinated such that the ramp (202) may be laid flat prior to accumulating print media (110) on the mezzanine support members (201) but also places the mezzanine support members (201) in a position to accumulate print media (110).

In the example shown in FIG. 8, if the print job is finished (YES Determination, 825), the method (800) may continue again by moving (805) each mezzanine support member (201) to a first position. If the print job is not finished (NO Determination, 825), the method (800) may continue to maintain (820) the mezzanine support members (201) in the second position. In one example, before the mezzanine support members (201) are moved to the first position and after all pages of the print job have been accumulated, various finishing processes may be conducted. These finishing processes may include, but are not limited to, stapling and hole punching. The controller (FIG. 1, 130) may control whether the finishing processes are conducted.

Where the use of the ramp (202) is not to be continued (NO Decision, 815), the mezzanine support members (201) are moved (830) to a third position. Movement (830) of the mezzanine support members (201) to the third position causes the rack arm (301) and accordingly, the rack arm trigger (401) to disengage the kickstand (303) from the ramp (202) by pulling on the kickstand finger (402). Consequently, the ramp (202) lays flat against the mezzanines support member (201). In one example, the mezzanine support members (201) may maintain their position in the third position. In another example, the mezzanine support member (201) may return to the second position as described above. Although FIG. 8 shows the process continuing from moving (830) the mezzanine support members (201) to a third position to determining (825) whether the print job is finished, in one example, the method (800) may be adjusted. In this example, instead the mezzanine support members (201) may be moved (810) to the second position, maintain that position (820), and then make a decision (825) as to whether the print job is finished. In this example, the decision (815) as to whether job to be printed is to implement a ramp (202) may be eliminated and the accumulation of the print media (110) may continue until the print job is completed.

As mentioned above, although the methods (700, 800) depict that certain processes occur after or before other processes, the present specification contemplates a number of examples. In these examples, any number of processes in the methods (700, 800) may be conducted previous or subsequent to other processes in those methods (700, 800).

The specification and figures describe a media tray and a method of implementing the media tray. The media tray may prevent curled edges of a subsequently printed print media from colliding with the trailing end of a previously printed print media. This is accomplished through the use of a ramp that abuts the leading edge of the printed print media such that the leading edge is taken over the trailing edge of a previously printed print media. This allows the media tray to receive any sized print media while still being able to register each page for finishing processes such as, but not limited to, stapling and hole punching. The ramp may be selectively erected or laid flat based on the size of the print media exiting a printing device. The erection and flattening of the ramp may be accomplished as a number of mezzanine support members are moved from a first position to a second position and from a second position to a third position.

In a number of examples, unlike other media trays, the media tray described herein may not implement additional mechanical drives, wiring, or spring forces to erect or drop the ramp. Additionally, in a number of examples, the ramp may be locked into position where appropriate and is not influenced by the weight of incoming print media. Further, in a number of examples, the complexity to reproduce parts is also minimized due to similar parts being used for both mezzanine support members.

The preceding description has been presented to illustrate and describe examples of the principles described. This description is not intended to be exhaustive or to limit these principles to any precise form disclosed. Many modifications and variations are possible in light of the above teaching.

What is claimed is:

1. A media tray comprising:

a number of mezzanine support members on which to accumulate media as the media is ejected from a printing device, the number of mezzanine support members being moveable laterally toward and away from a center of the media tray which is along a direction the media moves into the media tray; and a number of ramps to selectively engage with a leading edge of the media as the media is accumulated, the number of ramps positionable between an erect position and a flat position by movement of the mezzanine support members.

2. The media tray of claim 1, further comprising a number of articulating extension bars supported on extension arms that extend away from the number of mezzanine support members to help support the media as the media accumulates on the mezzanine support members.

3. The media tray of claim 1, further comprising a kickstand with each ramp, wherein the number of ramps are selectively engaged with a leading edge of the media by holding the ramp up with a corresponding kickstand.

4. The media tray of claim 3, wherein the kickstand engages the ramp via movement of a finger extending from a rack arm.

5. The media tray of claim 4, wherein the movement of the finger extending from the rack arm is accomplished by a number of gears actuated by a linking gear slidingly engaging a corresponding mezzanine support member.

6. The media tray of claim 1, wherein the ramps are engaged when the size of the media does not extend over the ramp when registered with a second wall of the media tray.

7. The media tray of claim 2, further comprising a rack arm having teeth engaged with teeth on the extension arms such that movement of the rack arm pivots the extension arms to extend or retract the articulating extension bars.

8. The media tray of claim 7, further comprising a linking gear that moves the rack arm in response to movement of one of the mezzanine support members.

9. The media tray of claim 8, wherein the linking gear comprises a half gear between teeth of the rack arm and teeth of a corresponding mezzanine support member.

10. The media tray of claim 7, further comprising a spring connected between the rack arm and a corresponding mezzanine support member.

11. A printing device comprising:

a media tray comprising a mezzanine level comprising a number of media support members, the mezzanine level being intermediate to a floor of the media tray and a media transport mechanism level;

wherein the media support members comprise a number of ramps to prevent a leading edge of a first print media from colliding with a trailing edge of a second print media accumulated on the media support members.

12. The printing device of claim 11, further comprising a ramp kickstand that supports the ramp when engaged with the ramp.

13. The printing device of claim 12, wherein the number of support members travel from a first position to a second position to hold a media as the media is ejected from the printing device and engage the kickstand to support the ramp.

14. The printing device of claim 13, wherein the number of support members travel from the second position to a third position to disengage the kickstand and allow the ramp to fall.

15. The printing device of claim 13, wherein travel of the support members from the second position to the first position results in the accumulated media being dropped to a floor of the media tray positioned below the mezzanine.

16. A method of preventing collision of media in a media tray, comprising:

moving a support structure from a first position to a second position laterally with respect to a direction of media entering the media tray, the support structure to receive a number of sheets of media on a mezzanine level within the media tray;

erecting a ramp on the support structure, wherein a lateral movement of the support structure causes the ramp to move; and accumulating the number of sheets of media on the support structure by translating each sheet over the ramp preventing a leading edge of each sheet from colliding with a trailing edge of a previously accumulated sheet in the tray.

17. The method of claim 16, wherein moving the support structure the first position causes a kickstand to be placed under the ramp to maintain the ramp in the erect position.

18. The method of claim 16, further comprising determining dimensions of the sheets of media and selectively moving the support structure and erecting the ramp based on the dimensions.

19. The method of claim 18, wherein the support structure is moved from the second position to a third position when it is determined that the dimensions of the sheets of media, when abutting a wall of the media tray, cover the ramp, movement of the support structure from the second position to the third position resulting in the ramp moving from an erect position to a flat position.

20. The method of claim 16, further comprising extending articulating extension bars on extension arms from each of the support structures in response to movement of the support structure, the extension arms being mechanically linked to a respective support structure.

* * * * *